US005131194A

United States Patent [19]

Anderson

[11] Patent Number: 5,131,194

[45] Date of Patent: Jul. 21, 1992

[54] SOUND BARRIER WINDOW

[75] Inventor: Robert B. Anderson, Edina, Minn.

[73] Assignee: MacArthur Company, St. Paul, Minn.

[21] Appl. No.: 687,197

[22] Filed: Apr. 18, 1991

Related U.S. Application Data

[63] Continuation-in-part of Ser. No. 348,569, May 8, 1989, abandoned.

[51] Int. Cl.[5] ..... E06B 5/20

[52] U.S. Cl. ..... 52/144; 52/788; 52/790; 52/399; 52/400; 52/401; 52/171

[58] Field of Search ..... 52/141, 171, 396, 398-402, 52/788-790, 202-203, 403

[56] References Cited

U.S. PATENT DOCUMENTS

| | | | |
|---|---|---|---|
| 2,258,973 | 10/1941 | Cross et al. | 52/401 |
| 2,378,031 | 6/1945 | Paddock | 52/398 |
| 2,700,196 | 1/1955 | Panhard | 52/400 |
| 2,736,404 | 2/1956 | Clingman | 52/400 |
| 2,781,111 | 2/1957 | Kunkel | 52/400 X |
| 3,875,706 | 4/1975 | Okawa | 52/398 X |
| 4,006,569 | 2/1977 | Kain | 52/400 X |
| 4,019,295 | 4/1977 | Derner et al. | 52/171 |
| 4,055,031 | 10/1977 | Okawa et al. | 52/398 X |
| 4,114,342 | 9/1978 | Okawa | 52/398 X |
| 4,203,264 | 5/1980 | Kiefer et al. | 52/171 X |
| 4,368,226 | 1/1983 | Mucaria | 52/788 X |
| 4,829,729 | 5/1989 | Derner et al. | 52/171 |
| 4,835,927 | 6/1989 | Michlovic | 52/400 |

FOREIGN PATENT DOCUMENTS

| | | | |
|---|---|---|---|
| 2532243 | 10/1976 | Fed. Rep. of Germany | 52/788 |
| 2730119 | 2/1979 | Fed. Rep. of Germany | 52/788 |

*Primary Examiner*—David A. Scherbel
*Assistant Examiner*—Robert Canfield
*Attorney, Agent, or Firm*—Palmatier & Sjoquist

[57] ABSTRACT

The present sound barrier double-pane window includes panes wherein each pane is of a different thickness or a different density or a combination thereof. Since panes of different thicknesses or densities block or dampen different sounds, the double-pane window provides a quieter interior environment than a conventional double-pane window. The present sound barrier window also includes a peripherally mountable gasket with multiple peripheral ribs and cusped, pane-receiving surfaces to provide a sound-deadening seal between the exterior and interior environments.

18 Claims, 2 Drawing Sheets

SOUND BARRIER WINDOW

This is a continuation-in-part of U.S. application Ser. No. 07/348,569, filed May 8, 1989 now abandoned.

The present invention relates to windows and, more particularly to windows which provide improved sound absorption and sound insulation.

BACKGROUND OF THE INVENTION

Many homes, offices, motels and other businesses have been and are being constructed near areas producing high environmental noise such as highways, airports, railroads, and factories. Conversely, industrial-type noise is increasingly invading the home environment as airports and highways are expanded or upgraded to handle larger volumes of traffic.

Noise pollution problems or scenarios as noted above are conventionally approached by controlling the source of the noise. Industries are typically confined to certain geographical areas by zoning ordinances and land use regulations. Moreover, noise is managed by encouraging changes or improvements in the noise-creating technology itself. For example, emphasis has been placed on designing commercial aircraft with quieter engines, and with shorter takeoff and landing capabilities.

Although noise may be mitigated by legislative regulation of nuisance industries and managed from within the industries, an individual has little ability or power to eliminate sources of noise. The individual, even if aligned with a citizen's or homeowner's organization, may not have the resources or power to be as influential as an industry's lobby upon a legislative body, especially when the industry, such as an airport, is crucial to the lifeline of a metropolitan area.

However, even though one may possess little power to decrease environmental noise, he or she may attempt to mitigate the noise through changing his or her surroundings by, for instance, erecting physical barricades. Such an approach is desirable not only in light of an individual's political inability to effect environmental noise, but because noise is often in the ear of the beholder. One individual's perception of noise may be different from his or her neighbor's impression.

An object of the present invention is to provide a sound-absorbing and sound-insulating window.

A feature of the present invention is a double-pane window wherein each pane is of a different thickness. Since window panes of different thicknesses have different natural resonant frequencies, they absorb or dampen different wavelengths or frequencies of sound. A window with panes of different thicknesses blocks a greater number of wavelengths or frequencies of sound than a double-pane window having panes of equal thicknesses.

Another feature of the present invention is a double-pane window wherein each pane has a different density. A window pane of a particular density has a particular natural resonant frequency, and eliminates or dampens sounds within a certain range of wavelengths or frequencies, while another pane of another density will absorb or block sound within a different range of wavelengths or frequencies. Hence, by combining panes of difference densities, noise is eliminated over a greater range of wavelengths or frequencies.

Another feature of the present invention is a nonrigid double-pane window. The panes of such a window are formed from a low density acrylic in a coextrusion process to provide a less rigid or flexible transparent pane. The molecules of a flexible window pane are more easily excited by the motion of air molecules created by a noise. Accordingly, the window absorbs the noise as thermal energy instead of transmitting the noise therethrough as sound.

Another feature of the present invention is the provision in a sound barrier double-pane window of an elastomeric foam gasket disposed about the periphery of the double-pane window wherein the double-pane window may be installed into the frame defined by an existing conventional window and adjacent to the conventional window.

Another feature of the present invention is a set of cusps extending into pane-receiving recesses in the elastomeric foam gasket to provide a complete seal between the panes and the gasket.

An advantage of the present invention is that it absorbs, insulates, dampens, and eliminates sound over a greater range of wavelengths or frequencies than a conventional double-pane window.

Another advantage of the present invention is that it produces a quieter interior environment and hence contributes to a workplace or home which is sociologically more acceptable to a greater number of people.

Another advantage of the present invention is that it allows an industry that traditionally has been a nuisance to be located closer geographically to office buildings or residential areas and therefore increases the types of usages of land.

Another advantage is that it is inexpensive and simple to manufacture.

Another advantage of the invention is that, when mounted peripherally in an elastomeric foam gasket, it is attachable to an existing window frame without removing the existing conventional window.

SUMMARY OF THE INVENTION

The present invention is an improved sound barrier window which can be placed into a recess in the wall of a building defined by the frame of a standing window existing therein. The frame of the existing, standing window typically defines an inwardly facing border. The present invention includes sound barrier panes, transparent in nature. The sound barrier panes are shaped similarly to the recess defined by the frame of the standing window and slightly smaller so that, around a peripheral edge of the panes there is created a small space if the panes were inserted into the recess. The invention further includes an elastomeric gasket which circumscribes the sound barrier panes to define a perimeter thereof. Although not essential to the invention, the gasket typically is mounted to the peripheral edge of the panes. The assembly of the sound barrier panes with the gasket attached thereto is shaped similarly to the recess defined by the frame and is sized slightly larger than the recess so that assembly can be pushed into the recess and press-fit therein.

DESCRIPTION OF THE PREFERRED EMBODIMENT

Figure 1:
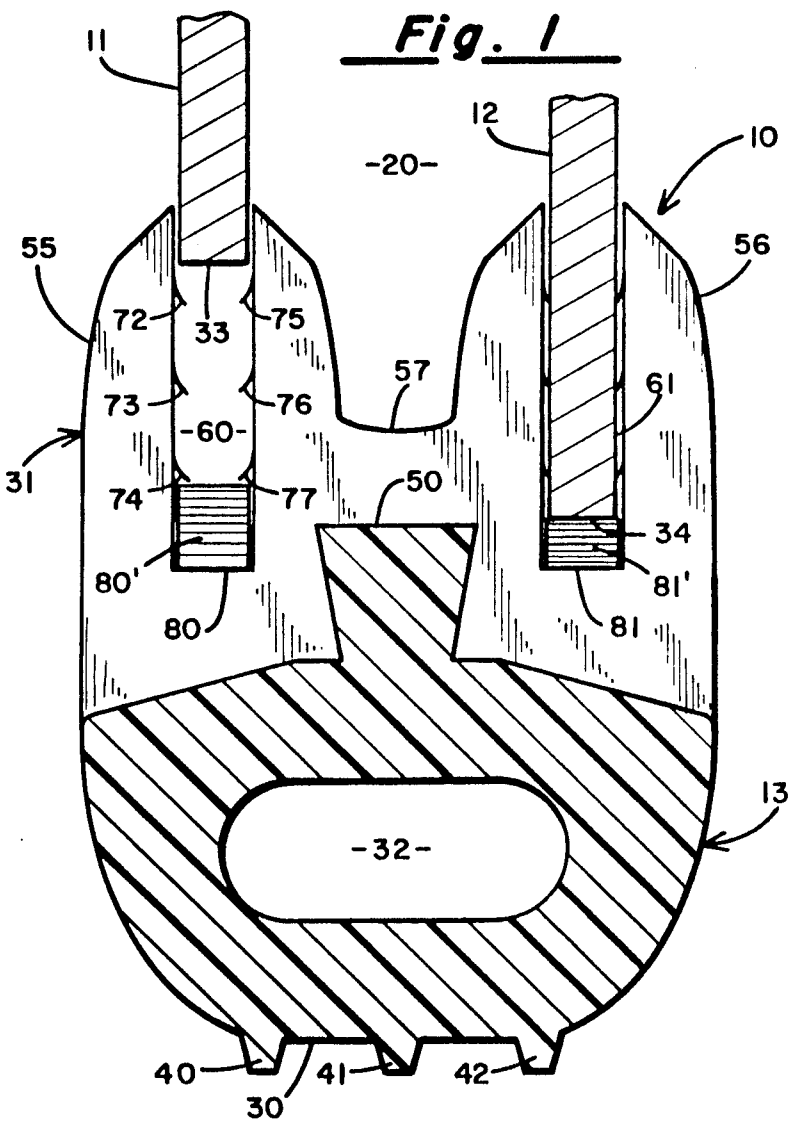
FIG. 1 is a partial section view of a sound barrier double-pane window partially disposed in an elastomeric foam gasket.

As shown in FIG. 1, a sound barrier window 10 includes a pair of respective thinner and thicker transparent panes 11, 12 mounted in an endless elastomeric foam gasket 13. Pane 11 is shown in partially inserted position. Thinner pane 11 is preferably formed of a material having a lower density than the material of thicker pane 12. However, if desired thinner pane 11 may have a greater density than thicker pane 12. An air space 20 is formed between panes 11, 12 and an air space 32 is formed interior of gasket 13.

The panes 11, 12 may be plastic or a type of plexiglass. One desirable plastic is a low-density acrylic. Such an acrylic is preferred because, in part, it is more flexible than a conventional window glass. If this material is selected the panes 11,12 may be approximately 87% less rigid than a conventional glass window pane. The panes 11, 12 may be formed by a coextrusion process.

It is known that acrylic material such as Plexiglas may be made by any of three different processes: the "cast" process produces a lower density sheet having excellent optical clarity; the "continuous cast" process produces a higher density acrylic sheet, with a somewhat lower quality; the "extruded" process produces the highest density sheet, but perhaps the lowest quality material. The density difference of acrylic sheets produced according to the various different processes can vary on the order of ten percent, and the preferred embodiment of the present invention utilizes an acrylic sheet made from one process in a first pane, and an acrylic sheet made from a second process in a second pane.

It is believed that the densities vary by virtue of the manufacturing process, and also by virture of differences in monomers used in the various processes. It is believed that a single process type could also be used to produce different acrylic densities, by varying the monomers and other ingredients used to make the acrylic, and this alternative is also contemplated by the present invention.

In operation, the thinner pane 11 absorbs or blocks sound differently from the thicker pane 12. If sound is defined as a vibratory disturbance in the pressure and density of a fluid, or in the elastic strain in a solid, with frequency in the approximate range between 20 and 20,000 cycles per second, then the thinner pane 11 absorbs sound vibrations at a different frequency or frequencies from the thicker pane 12. Hence, when thinner pane 11 is combined with thicker pane 12 in gasket 13, sound over a greater number of frequencies is absorbed or eliminated.

If the thickness of pane 11 is equal to the thickness of pane 12, and the density of pane 11 is different from the density of pane 12, pane 11 absorbs sound vibrations at a different frequency or frequencies from pane 12. Accordingly, when panes of different densities are mounted in one gasket such as the gasket 13, sound of a greater number of frequencies is absorbed or eliminated.

It should be noted that pane 11 may be thinner and have a lesser density than pane 12, or be thinner and have a greater density than pane 12. Furthermore, pane 11 may be thicker than pane 12 and have a lesser density than pane 12, or be thicker and have a greater density than pane 12.

The elastomeric foam gasket 13 includes an outer channeled ribbed base portion 30 mounted peripherally of an inner, recessed, pane-receiving portion 31. The base 30 includes a continuous interior passage 32 extending generally parallel to peripheral edges 33, 34 of the respective panes 11, 12. The gasket 13 may be formed from ethylene propylene rubber (EPDM).

The base 30 also includes a set of three integral, sealing resilient ribs 40, 41, 42 extending outwardly from an outer edge of the base 30. Outer ribs 40, 42 are canted slightly away from the substantially upright middle rib 41.

The outer, base portion 30 further includes an inwardly-extending trapezoidal-like medial strip 50 extending medially into the inner portion 31. The distal portion of the strip 50 is wider than the proximal portion so that the trapezoidal strip 50 is securely seated in the inner portion 31. Although the portions 30, 31 may be formed separately, when affixed together as herein, the portions 30, 31 are substantially integral and one piece.

The inner endless portion 31 includes a pair of pane-receiving appendages 55, 56 extending inwardly from each side of the medial trapezoidal strip 50. The appendages 55, 56 are integrally connected by a medial connector 57 which lies over and is affixed to the distal portion of the trapezoidal medial strip 50.

The appendages 55, 56 form a pair of respective pane-receiving recesses 60, 61. Recess 60 is typically of a lesser width than recess 61 and of substantially the same width of the thickness of pane 11. Recess 61 is substantially the same width of the thickness of pane 12.

Each of the recesses 60, 61 typically include a respective set of three resilient oblique cusps 72, 73, 74 and 75, 76, 77. The opposing resilient oblique cusps 72–77 extend into the recesses 60, 61 and obliquely outwardly to the appendages 55, 56. The cusps 72–77 allow the panes 11, 12 to slide into their respective recesses 60, 61, but preclude movement of the panes 11, 12 out of their respective recesses 60, 61. As the panes 11, 12 are inserted into the recesses 60, 61, the panes 11, 12 slide against and bend the cusps against their respective walls. If an attempt is made to withdraw as the panes 11, 12 from the recesses 60, 61, the cusps 72–77 may roll back as the panes 11, 12 are withdrawn so that the edges press against the panes 11, 12, thereby exerting a greater inward force on the panes 11, 12 to resist their removal from the gasket 30.

Each of the recesses 60, 61 is also formed in part by a floor 80, 81. Disposed between the floor 80, 81 and the peripheral edges 33, 34 of the panes 11, 12 is an undulating, resilient, endless spring 80', 81'.

Figure 2:
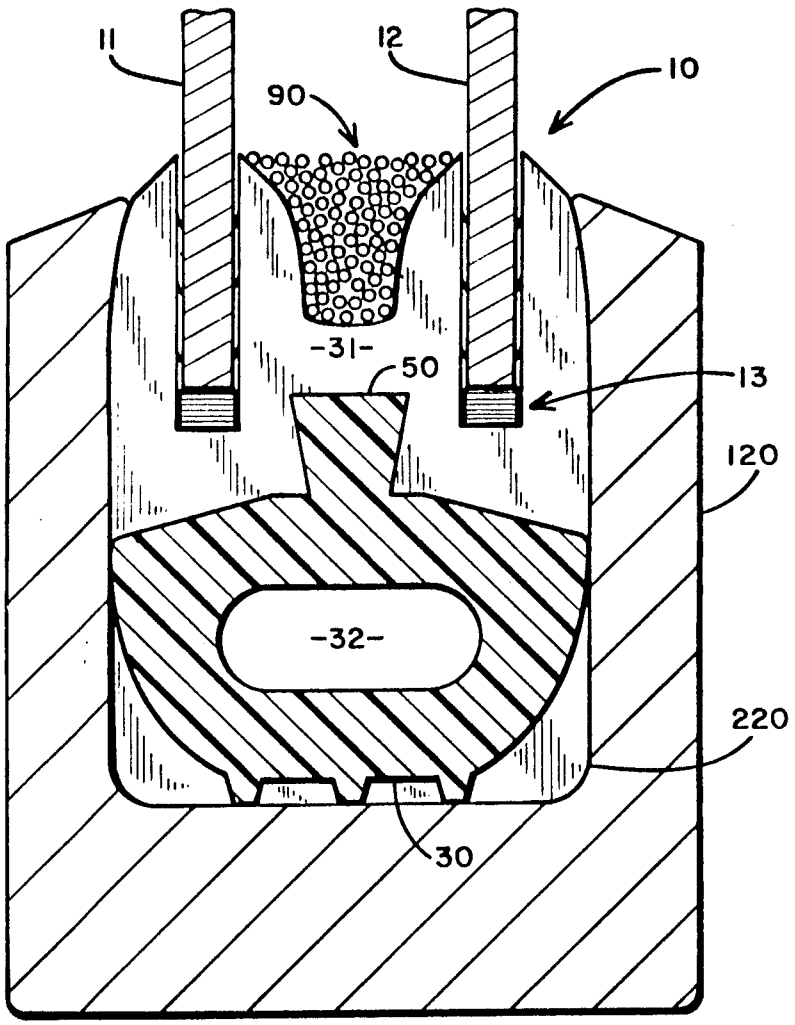
FIG. 2 is a partial section view of the sound barrier window of FIG. 1 disposed in an existing window frame.

Referring now to FIG. 2, the frame 120 of the in-place window 10 defines an inwardly facing recess 220 into which the gasket 13 in accordance with the present invention can be fit. The resilient or elastomeric gasket 13 can be mounted to the interior recess 220 of the frame 120. Depending upon the application and the manner in which the invention is to be marketed, the gasket 13 may or may not be affixed to the peripheral edges of the panes 11, 12. In applications where the sound barrier is to be marketed as a complete unit, the gasket 13 would, of course, be preattached to the panes 11, 12 and sold in that configuration. On the other hand, the gasket 13 can be sold as a kit to adapt an appropriately sized and shaped sound barrier pane for use as a sound barrier. In such an application, the gasket 13 would be sold in kit form, and the purchaser would provide the panes to which the gasket 13 would be attached. In either case, however, only an assembly comprising the sound barrier panes 11, 12 and the gasket 13 would actually be installed within the recess 220 defined by the frame 120 of the in-place window 10. A plurality of sound-absorbing particles 90 may be contained within the gasket 13 recess between panes 11, 12.

An accumulation of open-celled urethane foam particles 90 may be used to fill the recess formed in the center portion 31 of gasket 13. It has been found that the open-celled urethane foam particles 90 act to further dampen vibrations of either pane 11 or pane 12.

The gasket 13 is dimensioned so that, when it is attached to the sound barrier panes 11, 12 and expanded to its normal configuration, the assembly of the panes 11, 12 and the gasket 13 mounted thereto would be substantially the same shape as the recess 220 defined by the in-place window frame 120 but slightly larger than the recess 220. Because of the elastomeric quality of the gasket 13, it can be deformed so that the pane/gasket assembly would be able to be press-fit into the recess 220 of the in-place window frame 120.

It has been found that a particularly appropriate material for forming the gasket 30 is ethylene propylene rubber (EPDM). Such a material has the appropriate characteristics and the right measure of deformability in order to function as the gasket in accordance with the present invention.

Figure 3:
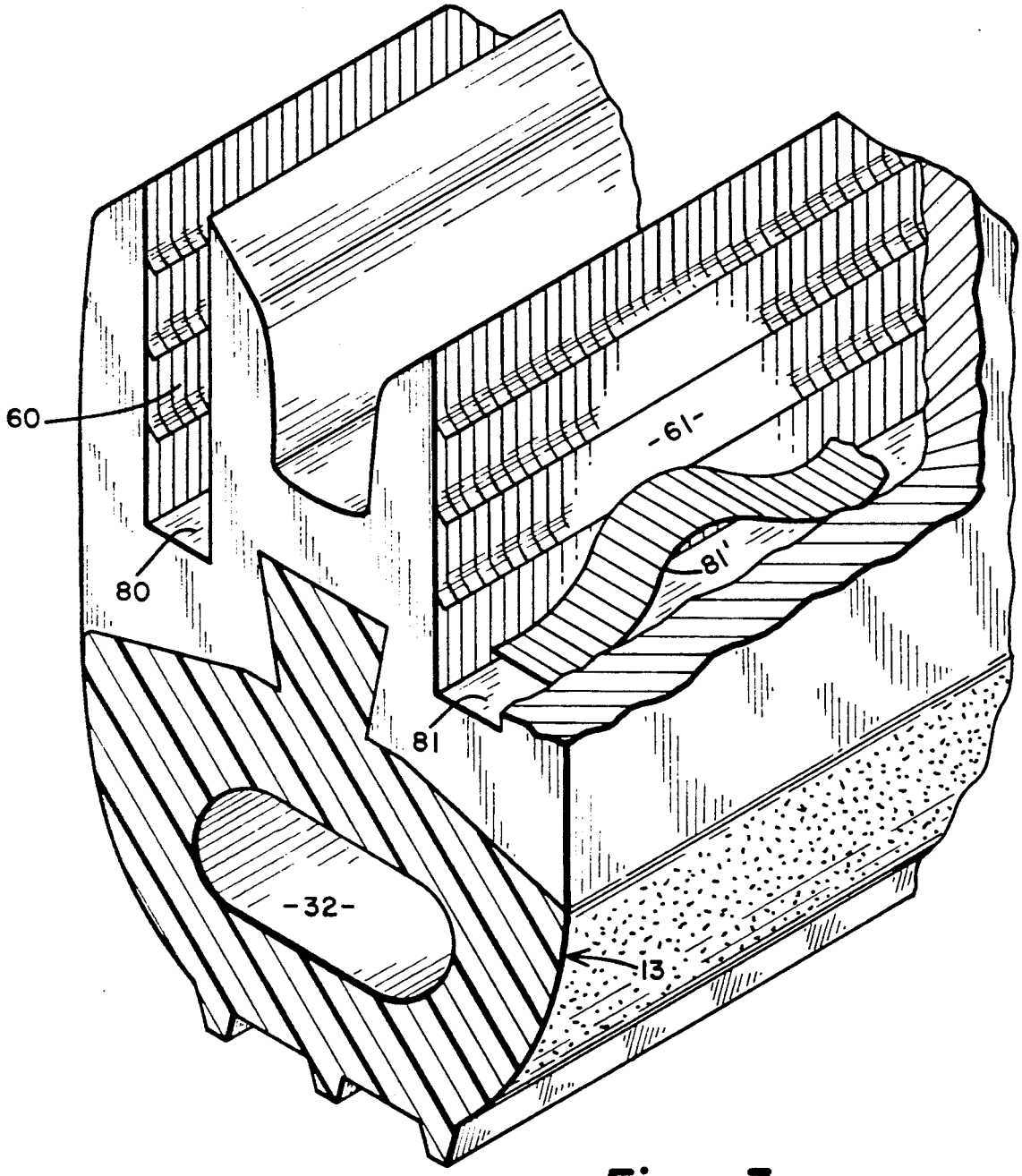
FIG. 3 is a perspective, partial section view of the elastomeric foam gasket.

Referring to FIG. 3, a portion of the gasket 13 is shown in perspective view. Recesses 60, 61 have respective floor sections 80, 81. An undulating spring 81' is shown positioned adjacent floor 81 of recess 61, and a similar spring is positioned on floor 80 of recess 60. These springs serve to resiliently contain the respective window panes, thereby assisting and securely holding the window frames within gasket 13. It is to be appreciated that the springs and recesses extend entirely about the periphery of the window panes, and the window panes are therefore entirely resiliently mounted within gasket 13. Gasket 13 is itself resiliently mounted within a window frame, as illustrated in FIG. 2, and therefore the entire window 10 forms a resilient mounting fixture for the panes 11 and 12.

In operation, the entire window assembly 10 may be provided as a unitary assembly and sold as a replacement window for existing installations, or as an original window for new construction. Alternatively, the components which go into forming the invention may be sold in either partially-assembled form or in a kit application form. In either case, it is apparent that the window panes may be inserted into the respective recesses of the gasket, and an adhesive may be used to assist in securing the window panes in place. Likewise, the gasket itself is inserted into an appropriate recess in a window frame by compression of the gasket and sliding into the recess. Adhesive may also be used in assisting and securing the gasket to the window frame assembly. By properly selecting the components, and the type of adhesives to be used, the various components of the window 10 may be disassembled in the event that repair or maintenance is required, by simply reversing the steps for constructing window 10. It is possible to assembly window 10 so as to evacuate or partially evacuate the space 20 between the panes, to thereby improve the thermal and sound transmission characteristics.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

I claim:

1. A double-pane window for providing sound insulation for an interior of a structure, comprising:

(a) a first pane comprising a first transparent sheet having a first thickness and a first density;

(b) a second pane comprising a second transparent sheet having a second thickness and a second density, the second sheet being of a thickness and density different from the first sheet; and (c) mounting means for mounting the panes in a spatial relationship to each other and in a window frame, the mounting means connected to and extending about the peripheries of the panes whereby the panes cooperate to block sound transmission, and thereby insulating the interior of the structure from a variety of sounds.

2. The window of claim 1, wherein the mounting means includes a resilient gasket, the gasket being deformable to allow the window to be pressed into a window frame.

3. The window of claim 2, and further comprising a depression formed medially in the gasket and a plurality of open-celled urethane foam particles in said depression.

4. The window of claim 2, wherien the gasket includes a passage formed therein and a rib integrally connected to the gasket and extending outwardly from the perimeter of the gasket, said passage allowing the gasket to be deformed when the window is placed in the window frame, the rib sealing the window to the window frame.

5. The window of claim 2, wherein the gasket includes a pair of pane-receiving recesses formed therein, the gasket having a plurality of cusps extending into the recesses to assist in providing a seal between the gasket and the panes.

6. The window of claim 5, wherein the gasket includes an undulating spring disposed in each of the recesses between the periphery of each fo the panes and the gasket, the undulating spring providing an inwardly directed pressure bearing against the peripheries of the panes.

7. A double-pane window for providing sound insulation for an interior of a structure, comprising:

(a) a first pane comprising a first glass sheet having a first density;

(b) a second pane comprising a second glass sheet having a second density, the second sheet having a density different from the first sheet and thereby blocking different sound frequencies; and (c) mounting means for mounting the panes in a spatial relationship to each other and in a window frame, the mounting means connected to and extending about the periphery of the panes whereby the panes cooperate to block different sounds and thereby insulating the interior of the structure from a variety of sounds.

8. The window of claim 7, wherein the second pane has a thickness different from the first pane.

9. The window of claim 7, wherein each of the panes has a pair of opposing, parallel, planar faces.

10. The window of claim 8, wherein the average thickness of the first pane is different from the average thickness of the second pane.

11. The window of claim 7, wherein the mounting means includes a resilient gasket, the gasket being deformable.

12. The window of claim 11, wherein the gasket includes a passage formed therein and a rib integrally connected to the gasket and extending outwardly from the perimeter of the gasket, said passage allowing the gasket to be deformed when the window is placed in the window frame, the rib sealing the window to the window frame.

13. The window of claim 11, wherein the gasket includes a pair of pane-receiving recesses formed therein, the gasket having a plurality of cusps extending into the recesses to assist in providing a seal between the gasket and the panes.

14. The window of claim 13, wherein the gasket includes an undulating spring disposed in each of the recesses between the periphery of each of the panes and the gasket, the undulating spring providing an inwardly directed pressure bearing against the peripheries of the panes.

15. A double-pane window for providing sound insulation, comprising:

(a) a first transparent sheet of acrylic material made form a first process taken from the group consisting of extruded, cast or continuous cast processes, said first transparent sheet having a first density;

(b) a second transparent sheet of acrylic material made from a second process, different from said first process, from the group consisting of extruded, cast or continuous cast processes, said second transparent sheet having a second density different from said first density; and (c) mounting means for mounting said first and second transparent sheets in spatial relationship to each other and in a window frame.

16. The apparatus of claim 15, wherein said first density and said second density vary by approximately ten percent.

17. The apparatus of claim 15, wherein said mounting means further comprises a resilient material about the peripheral edges of both said first transaprent sheet and said second transparent sheet.

18. The apparatus of claim 15, wherein said mounting means further comprises an interior recess between said first and second transparent sheets and said interior recess is at least partially filled with open-celled urethane foam particles.

* * * * *